US007299919B1

(12) United States Patent
Eliassof

(10) Patent No.: US 7,299,919 B1
(45) Date of Patent: Nov. 27, 2007

(54) DISPLAYABLE INDICIA BOX

(76) Inventor: Jack Eliassof, 3 Maxine Ave., Plainview, NY (US) 11803

( * ) Notice: Subject to any disclaimer, the term of this patent is extended or adjusted under 35 U.S.C. 154(b) by 347 days.

(21) Appl. No.: 10/914,029

(22) Filed: Aug. 6, 2004

(51) Int. Cl.
*B65D 85/00* (2006.01)

(52) U.S. Cl. ..... 206/232; 206/459.5

(58) Field of Classification Search ..... 206/232, 206/486, 459.5, 775–778, 781, 782, 767–770; 40/312; 229/162.6
See application file for complete search history.

(56) References Cited

U.S. PATENT DOCUMENTS

| | | | | | |
|---|---|---|---|---|---|
| 2,058,648 | A * | 10/1936 | Wellman | 206/769 |
| 2,644,259 | A | 7/1953 | Beadle | |
| 3,380,575 | A * | 4/1968 | Hennessey | 206/769 |
| 3,679,047 | A | 7/1972 | Papirnyik | |
| 3,835,989 | A * | 9/1974 | Mori et al. | 206/769 |
| 3,849,917 | A * | 11/1974 | Bergh et al. | 40/312 |
| 4,641,442 | A | 2/1987 | Filmer | |
| 4,813,534 | A | 3/1989 | Rosen | |
| 4,899,879 | A | 2/1990 | Rosen | |
| D335,963 | S | 6/1993 | Tracey | |
| 5,396,999 | A * | 3/1995 | Sandheinrich | 206/542 |
| 5,641,064 | A * | 6/1997 | Goserud | 206/775 |
| 5,718,336 | A * | 2/1998 | Haarlander | 206/232 |
| 5,860,589 | A * | 1/1999 | Hsu | 206/232 |
| 6,371,296 | B1 * | 4/2002 | Rumbough | 206/494 |
| 6,622,867 | B2 * | 9/2003 | Menceles | 206/771 |

* cited by examiner

*Primary Examiner*—Luan K Bui
(74) *Attorney, Agent, or Firm*—Richard L. Miller

(57) ABSTRACT

A displayable indicia box. A lid is operatively connected to a body. Viewing apparatus is associated with the body and/or the lid and allows viewing of indicia. The viewing apparatus includes the body and/or the lid having at least one slot therein and at least one strip having the indicia thereon. The at least one strip having the indicia thereon is replaceably mounted in the at least one slot, respectively, and is viewable when within the at least one slot by virtue of an exposed portion of the body and/or the lid associated with the at least one slot being transparent.

5 Claims, 2 Drawing Sheets

DISPLAYABLE INDICIA BOX

BACKGROUND OF THE INVENTION

1. Field of the Invention

The present invention relates to a box. More particularly, the present invention relates to a displayable indicia box.

2. Description of the Prior Art

Numerous innovations for boxes have been provided in the prior art that will be described. Even though these innovations may be suitable for the specific individual purposes to which they address, however, they differ from the present invention.

A FIRST EXAMPLE, U.S. Pat. No. 2,644,259 to Beadle teaches a box designed for use with pharmaceutical prescriptions comprising interfitted body and cover members, the cover number comprising a completely closed top and side walls and being made of a clear transparent molded product, a label dimensioned to fit into the inside of the cover against the inner face of the top, opposed nub-like projections formed on the inner surface of two opposite cover walls adjacent the top and in spaced relationship, and a transparent flat plate of flexible material fitted into the cover against the inside of the closed top, the opposite longitudinal edges of the plate having detachable locking engagement over the num-like projections on the cover walls for holding the label in flat assembled position against the inner surface of the top, the flat plate being provided with a cut-out in one edge to facilitate the removal of the plate.

A SECOND EXAMPLE, U.S. Pat. No. 3,679,047 to Papirnyik teaches a box for storing attachments and an instruction booklet for a sewing machine or similar household appliance having a receptacle for storage of the attachments and a transparent plastic top cover for storing the instruction booklet with the graphics and indicia of the booklet positioned for display through the top. The top includes a convex surface and a ledge or shelf juxtaposed slightly therebelow on opposite sides thereof. The booklet is positioned within the top with its sides supported on the shelves. The spacing between each shelf and the top surface, and the surface area of the top between the shelves, is such that the booklet conforms substantially to the shape of the convex top. A hole in the top allows removal of the booklet by manual application of a force against the visible surface of the booklet. Various model instruction booklets having model identifying graphics printed thereon may selectively be positioned within the box with the corresponding attachments to standardize and limit the number of different boxes manufactured and stored.

A THIRD EXAMPLE, U.S. Pat. No. 4,641,442 to Filmer teaches a display unit for displaying indicia such as advertising material that has a light box in which there are a series of lights. The box has a reflective surface capable of passing light outwardly from inside the box but reflecting light applied exteriorly of the surface. Indicia are mounted within the box carrying translucent and washed areas. Lighting of the lights displays the indicia and extinguishing the lights results in a mirrored surface only being apparent. Modification include making the masked areas of a reflective material to give a repeated reflection effect when the lights are lit.

A FOURTH EXAMPLE, U.S. Pat. No. 4,813,534 to Rosen teaches a display package for holding a folded box for audio-visual material having indicia describing the box contents which consists of a transparent envelope, the envelope comprising sheets of plastic material secured together on their edges, one edge being open to permit the folded box to be inserted into and withdrawn from the envelope, one sheet being rigid for holding the envelope upstanding, there being a stop seam at one end of the envelope to hold the folded box positioned away from the envelope edge, and a pocket secured to the envelope on its end opposite the stop seam for holding information related to the category of the audio-visual material. The invention also relates to an indexing system for audio-visual material where a plurality of like such display packages are arranged one behind another in a bin, packed loosely to allow one package to be flipped away from another package for selective browsing through the packages, and to a method for arranging such a system which consists of the steps of removing the materials from their boxes, folding the boxes to a flattened condition, inserting each box into such a display package and arranging the packages upright in a bin for browsing therethrough by a consumer.

A FIFTH EXAMPLE, U.S. Pat. No. 4,899,879 to Rosen teaches a display package for holding a folded box for audio-visual material having indicia describing the box contents which consists of a transparent envelope, the envelope comprising sheets of plastic material secured together on their edges, one edge being open to permit the folded box to be inserted into and withdrawn from the envelope, one sheet being rigid for holding the envelope upstanding, thereby being a stop seam at one end of the envelope to hold the folded box positioned away from the envelope edge, and a pocket secured to the envelope on its end opposite the stop seam for holding information related to the category of the audio-visual material. The invention also relates to an indexing system for audio-visual material where a plurality of like such display packages are arranged one behind another in a bin, packed loosely to allow one package to be flipped away from another package for selective browsing through the packages, and to a method for arranging such a system which consists of the steps of removing the materials from their boxes, folding boxes to a flattened condition, inserting each box into such a display package and arranging the packages uprights in a bin for browsing therethrough by a consumer. The display package pocket also includes novel means for holding indicia placed therein from falling from the pocket during flipping and handling of the packages.

A SIXTH EXAMPLE, U.S. Pat. No. Des. 335,963 to Tracey teaches the ornamental design for a shadow box.

It is apparent that numerous innovations for boxes have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a displayable indicia box that avoids the disadvantages of the prior art.

ANOTHER OBJECT of the present invention is to provide a displayable indicia box that is simple to use.

BRIEFLY STATED, STILL ANOTHER OBJECT of the present invention is to provide a displayable indicia box. A lid is operatively connected to a body. Viewing apparatus is associated with the body and/or the lid and allows viewing of indicia. The viewing apparatus includes the body and/or the lid having at least one slot therein and at least one strip having the indicia thereon. The at least one strip having the indicia thereon is replaceably mounted in the at least one slot, respectively, and is viewable when within the at least one slot by virtue of an exposed portion of the body and/or the lid associated with the at least one slot being transparent.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Generic

Figure 1:
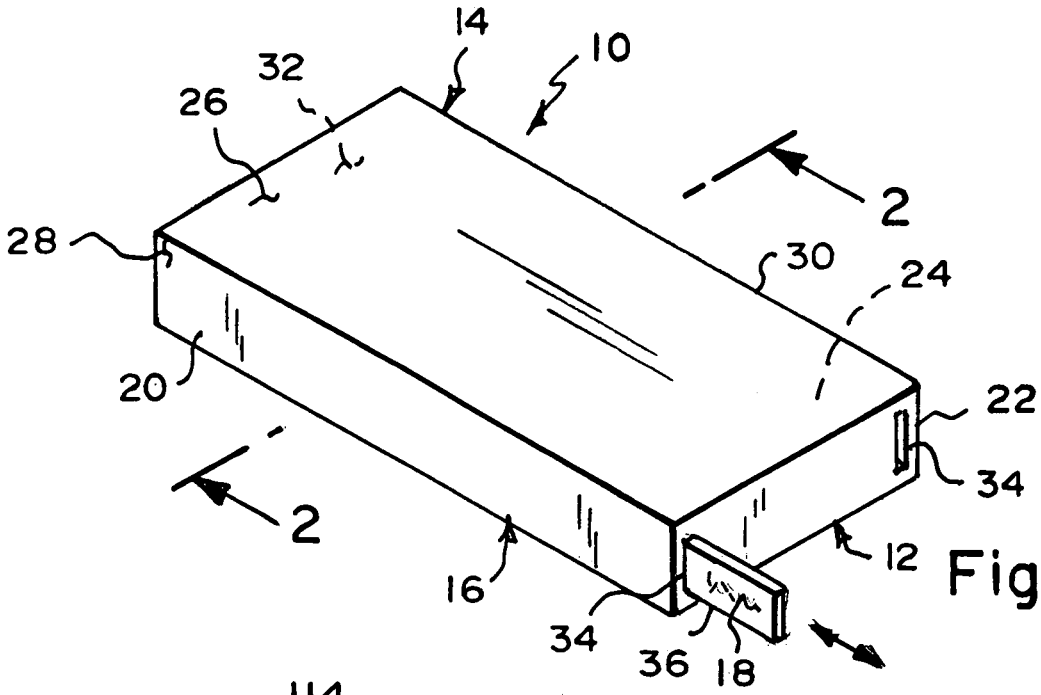
FIG. 1 is a diagrammatic perspective view of the present invention.

10 displayable indicia box of present invention
12 body
14 lid
16 viewing apparatus
18 indicia
20 front wall of body 12
22 rear wall of body 12
24 open top of body 12
26 top surface of lid 14
28 front surface of lid 14
30 rear surface of lid 14
32 bottom surface of lid 14
34 at least one slot in at least one of body 12 and lid 14 of viewing apparatus 16
36 at least one strip having indicia 18 thereon of viewing apparatus

First Embodiment

110 displayable indicia box of present invention
112 body
114 lid
116 viewing apparatus
118 indicia
120 front wall of body 112
122 rear wall of body 112
130 rear surface of lid 114
134 at least one slot of viewing apparatus 116
136 at least one strip having indicia 118 thereon of viewing apparatus 116
138 hinge

Second Embodiment

210 displayable indicia box of present invention
212 body
214 lid
216 viewing apparatus

Third Embodiment

310 displayable indicia box of present invention
312 body
314 lid
316 viewing apparatus
320 front wall of body 312
322 rear wall of body 312
328 front surface of lid 314
330 rear surface of the lid 314

Fourth Embodiment

410 displayable indicia box of present invention
416 viewing apparatus
414 lid

Fifth Embodiment

510 displayable indicia box of present invention
512 body
514 lid
520 front wall of body 512
522 rear wall of body 512
528 front surface of lid 514
530 rear surface of lid 514

Sixth Embodiment

610 displayable indicia box of present invention

DETAILED DESCRIPTION OF THE PREFERRED EMBODIMENT

Referring now to the figures, in which like numerals indicate like parts, and particularly to FIG. 1, the displayable indicia box of the present invention is shown generally at 10.

The displayable indicia box 10 comprises a body 12, a lid 14, and viewing apparatus 16. The lid 14 is operatively connected to the body 12. The viewing apparatus 16 is associated with at least one of the body 12 and the lid 14, and allows viewing of indicia 18.

The body 12 has a front wall 20, a rear wall 22, and an open top 24.

The lid 14 has a top surface 26, a front surface 28, a rear surface 30, and a bottom surface 32.

The viewing apparatus 16 comprises at least one of the body 12 and the lid 14 having at least one slot 34 therein and at least one strip 36 having the indicia 18 thereon. The at least one strip 36 having the indicia 18 thereon of the viewing apparatus 16 is replaceably mounted in the at least one slot 36 of the viewing apparatus 16, respectively, and is viewable when therein by virtue of an exposed portion of at least one of the body 12 and the lid 14 associated with the at least one slot 36 of the viewing apparatus 16 being transparent.

Figure 2:
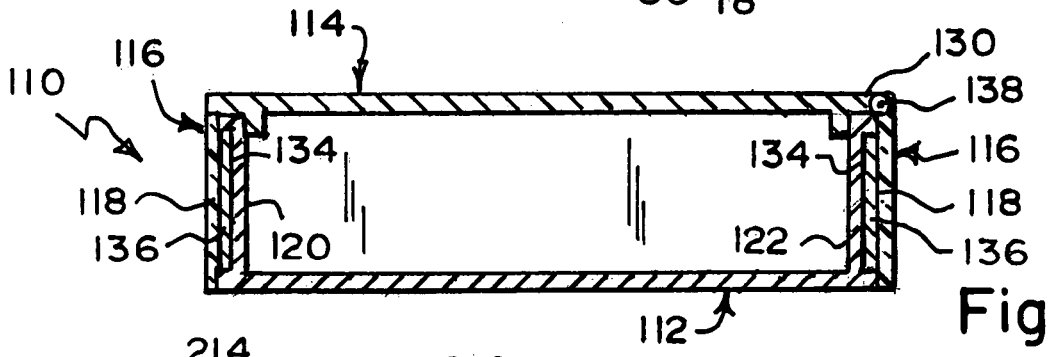
FIG. 2 is an enlarged diagrammatic cross sectional view taken along LINE 2-2 in FIG. 1 of a first embodiment of the present invention.

A first embodiment of the displayable indicia box 110 can best be seen in FIG. 2, and as such, will be discussed with reference thereto.

The displayable indicia box 110 has the rear surface 130 of the lid 114 hinged by hinge 138 to the rear wall 122 of the body 112.

The at least one slot 134 of the viewing apparatus 116 is disposed along the front wall 120 of the body 112 and in the rear wall 122 of the body 112, repsectively.

The at least one strip 136 having the indicia 118 thereon of the viewing apparatus 116 is disposed in the at least one slot 134 of the viewing apparatus 116 along the front wall 120 of the body 112 and along the rear wall 122 of the body 112, repsectively, and are visable therefrom by virtue of an exposed portion of the front wall 120 of the body 112 and an exposed portion of the rear wall 122 of the body 112 being transparent.

Figure 3:
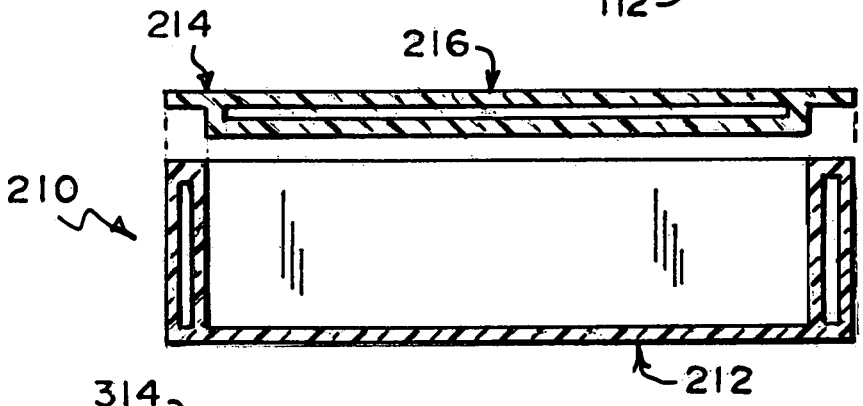
FIG. 3 is an enlarged diagrammatic cross sectional view taken along LINE 2-2 in FIG. 1, similar to FIG. 2, of a second embodiment of the present invention.

A second embodiment of the displayable indicia box 210 can best be seen in FIG. 3, and as such, will be discussed with reference thereto.

The displayable indicia box 210 is similar to the displayable indicia box 110, except that:

1. The lid 214 is unattached to the body 212.

2. The viewing apparatus 216 is further associated with the lid 214.

Figure 4:
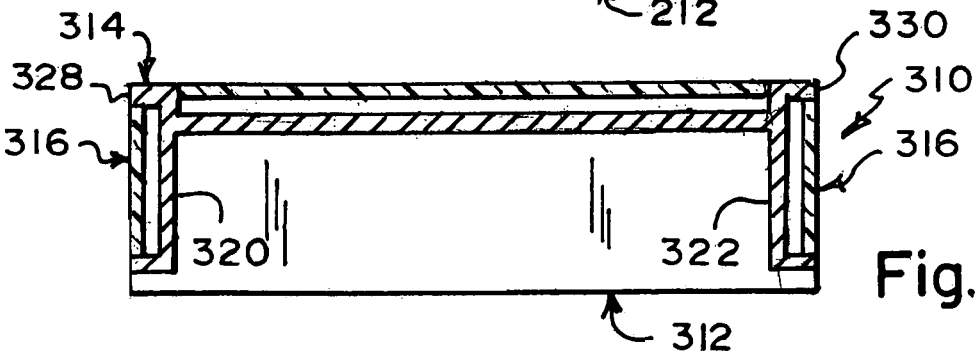
FIG. 4 is an enlarged diagrammatic cross sectional view taken along LINE 2-2 in FIG. 1, similar to FIG. 2, of a third embodiment of the present invention.

A third embodiment of the displayable indicia box 310 can best be seen in FIG. 4, and as such, will be discussed with reference thereto.

The displayable indicia box 310 is similar to the displayable indicia box 210, except that:

1. The viewing apparatus 316 is further associated with the front surface 328 of the lid 314 and the rear surface 330 of the lid 314, instead of the front wall 320 of the body 312 and the rear wall 322 of the body 312.
2. The front surface 328 of the lid 314 and the rear surface 330 of the lid 314 are flush with the front wall 320 of the body 312 and the rear wall 322 of the body 312, respectively.

Figure 5:
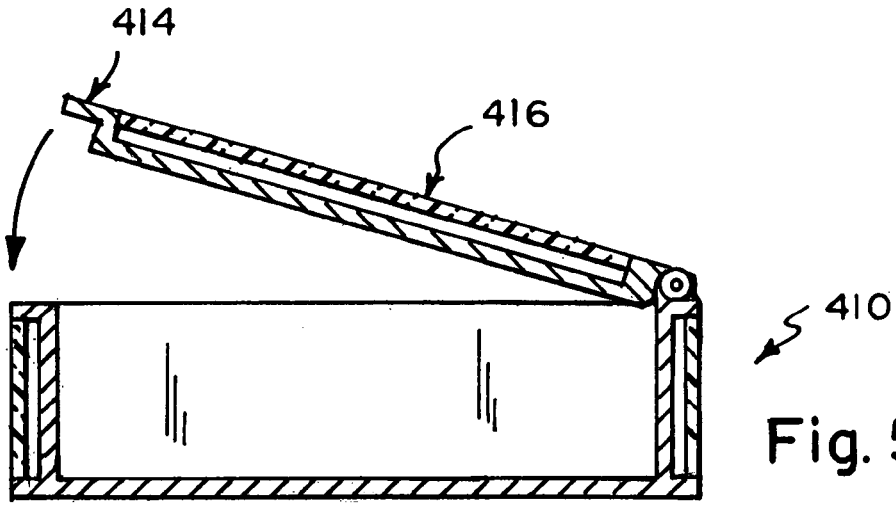
FIG. 5 is an enlarged diagrammatic cross sectional view taken along LINE 2-2 in FIG. 1, similar to FIG. 2, of a fourth embodiment of the present invention.

A fourth embodiment of the displayable indicia box 410 can best be seen in FIG. 5, and as such, will be discussed with reference thereto.

The displayable indicia box 410 is similar to the displayable indicia box 110, except that the viewing apparatus 416 is further associated with the lid 414.

Figure 6:
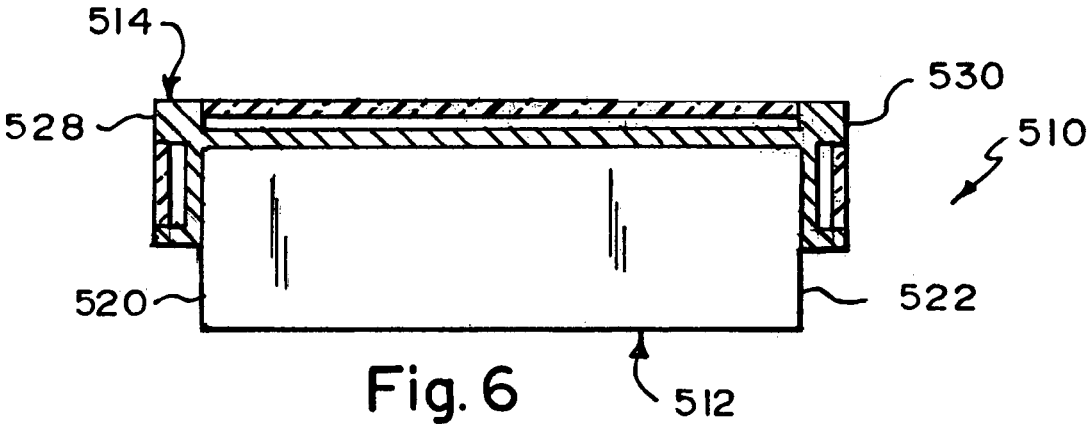
FIG. 6 is an enlarged diagrammatic cross sectional view taken along LINE 2-2 in FIG. 1, similar to FIG. 2, of a fifth embodiment of the present invention.

A fifth embodiment of the displayable indicia box 510 can best be seen in FIG. 6, and as such, will be discussed with reference thereto.

The displayable indicia box 510 is similar to the displayable indicia box 310, except that the front surface 528 of the lid 514 and the rear surface 530 of the lid 514 stick out from the front wall 520 of the body 512 and the rear wall 522 of the body 512, respectively.

The displayable indicia box 110, 210, 310, 410, and 510 are rectangular-shaped.

Figure 7:
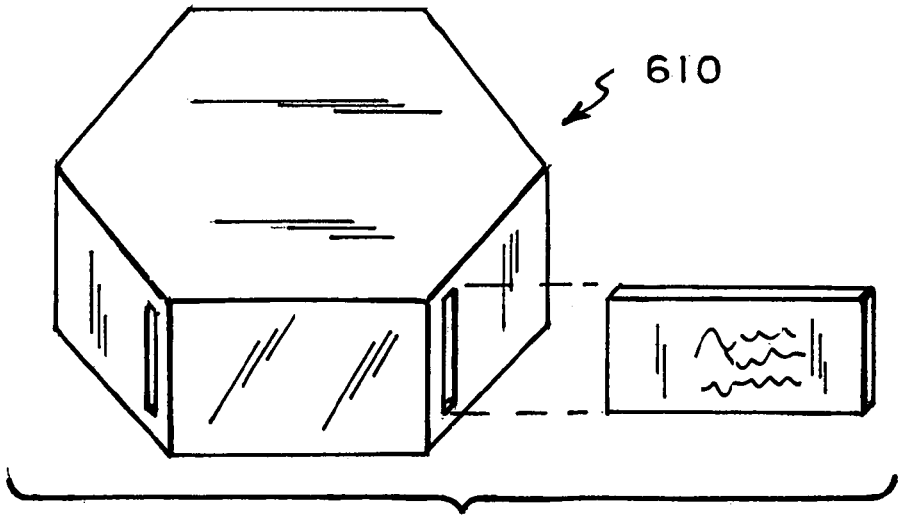
FIG. 7 is a diagrammatic perspective view of a sixth embodiment of the present invention.

A sixth embodiment of the displayable indicia box 610 can best be seen in FIG. 7, and as such, will be discussed with reference thereto.

The displayable indicia box 610 is similar to any of the displayable indicia boxs 110, 210, 310, 410, and 510, except that it is hexagonally-shaped.

It will be understood that each of the elements described above, or two or more together, may also find a useful application in other types of constructions differing from the types described above.

While the invention has been illustrated and described as embodied in a displayable indicia box, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A displayable indicia box, comprising:

a) a body:

b) a lid; and c) viewing apparatus;

wherein said lid is operatively connected to said body;

said viewing apparatus is associated with at least one of said body and said lid;

wherein said viewing apparatus allows viewing of indicia;

wherein said body had a front wall;

wherein said body has a rear wall; and wherein said viewing apparatus comprises each of said front wall of said body, said rear wall of said body, and said lid having at least one slot therein, wherein said lid has a front surface;

wherein said lid has a rear surface, wherein said viewing apparatus comprises at least one strip having said indicia thereon;

wherein said at least one strip having said indicia thereon of said viewing apparatus is replaceably mounted in said at least one slot of said viewing apparatus, respectively;

wherein said at least one strip having said indicia thereon of said viewing apparatus is viewable when within said at least one slot of said viewing apparatus, wherein said at least one strip having said indicia thereon of said viewing apparatus is viewable when within said at least one slot of said viewing apparatus by virtue of an exposed portion of at least one of said body and said lid associated with said at least one slot of said viewing apparatus being transparent, wherein one slot of said viewing apparatus is disposed along said front wall of said body; and another slot of said viewing apparatus is disposed along said rear wall of said body.

2. The box as defined in claim 1, wherein one strip having said indicia thereon of said viewing apparatus is disposed in said one slot of said viewing apparatus along said front wall of said body;

wherein another strip having said indicia thereon of said viewing apparatus is disposed in said another slot of said viewing apparatus along said rear wall of said body;

wherein said one strip having said indicia thereon of said viewing apparatus is visible when within said one slot of said viewing apparatus along said front wall of said body; and wherein said another strip having said indicia thereon of said viewing apparatus is visible when within said another slot of said viewing apparatus along said rear wall of said body.

3. The box as defined in claim 2, wherein said one strip having said indicia thereon of said viewing apparatus is visible when within said one slot of said viewing apparatus along said front wall of said body being transparent; and wherein said another strip having said indicia thereon of said viewing apparatus is visible when within said another slot of said viewing apparatus along said rear wall of said body by virtue of an exposed portion of said rear wall of said body being transparent.

4. The box as defined in claim 3, wherein said rear surface of said lid is hinged by hinge to said rear wall of said body.

5. The box as defined in claim 1, wherein said displayable indicia box is rectangular-shaped.

* * * * *